US007337847B2

(12) United States Patent
McGarian et al.

(10) Patent No.: US 7,337,847 B2
(45) **Date of Patent: *Mar. 4, 2008**

(54) MULTI-CYCLE DOWNHOLE APPARATUS

(75) Inventors: Bruce McGarian, Stonehaven (GB); Rory McCrae Tulloch, Aberdeen (GB); Ian A. Gillies, Brechin (GB)

(73) Assignee: Smith International, Inc., Houston, TX (US)

( * ) Notice: Subject to any disclaimer, the term of this patent is extended or adjusted under 35 U.S.C. 154(b) by 264 days.

This patent is subject to a terminal disclaimer.

(21) Appl. No.: 10/531,984

(22) PCT Filed: Oct. 17, 2003

(86) PCT No.: PCT/GB03/04490

§ 371 (c)(1),
(2), (4) Date: Jun. 14, 2005

(87) PCT Pub. No.: WO2004/038170

PCT Pub. Date: May 6, 2004

(65) Prior Publication Data

US 2005/0230119 A1 Oct. 20, 2005

(30) Foreign Application Priority Data

Oct. 22, 2002 (GB) ..... 0224522.3

(51) Int. Cl.
*E21B 34/12* (2006.01)

(52) U.S. Cl. ..... 166/334.4; 166/331

(58) Field of Classification Search ..... 175/231; 166/321, 334.4, 331, 334.1
See application file for complete search history.

(56) References Cited

U.S. PATENT DOCUMENTS 6,173,795 B1 * 1/2001 McGarian et al. ..... 175/231
6,820,697 B1 * 11/2004 Churchill ..... 166/374

FOREIGN PATENT DOCUMENTS

| | | | |
|---|---|---|---|
| EP | 0222620 | | 5/1987 |
| EP | 0994236 | | 4/2000 |
| GB | 2309470 A | * | 7/1997 |
| GB | 2347443 | | 9/2000 |
| GB | 2347443 A | * | 9/2000 |
| WO | 9747850 | | 12/1997 |

* cited by examiner

*Primary Examiner*—Jennifer H. Gay
*Assistant Examiner*—Daniel P Stephenson
(74) *Attorney, Agent, or Firm*—Dykema Gossett PLLC

(57) ABSTRACT

A downhole apparatus which can be used as multi-cycle circulating subs utilized in downhole drilling operations, includes a piston (242) slidably mounted in a body between positions in which at least one aperture in the body is opened and closed. Movement of the piston (242) is controlled by a pin (86), secured to one of the body and a control member, and a control groove (52) formed in the other of the body and control member for receiving a portion of the pin. An arrangement of elements (232, 276) respectively connected to the control member and body is such as to normally resist axial movement of the control member from a first axial position to a second axial position. A spring (44) is located in a chamber for biasing the piston (242). The chamber is vented by an opening in the body.

12 Claims, 11 Drawing Sheets

Fig.11.
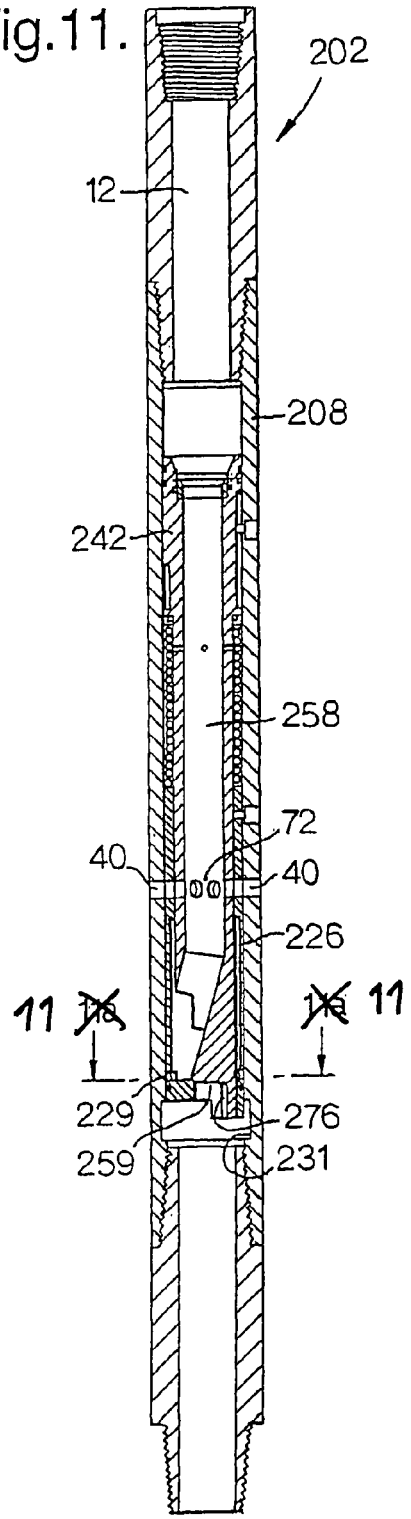
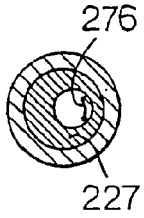
Fig.11a.
Fig.12.
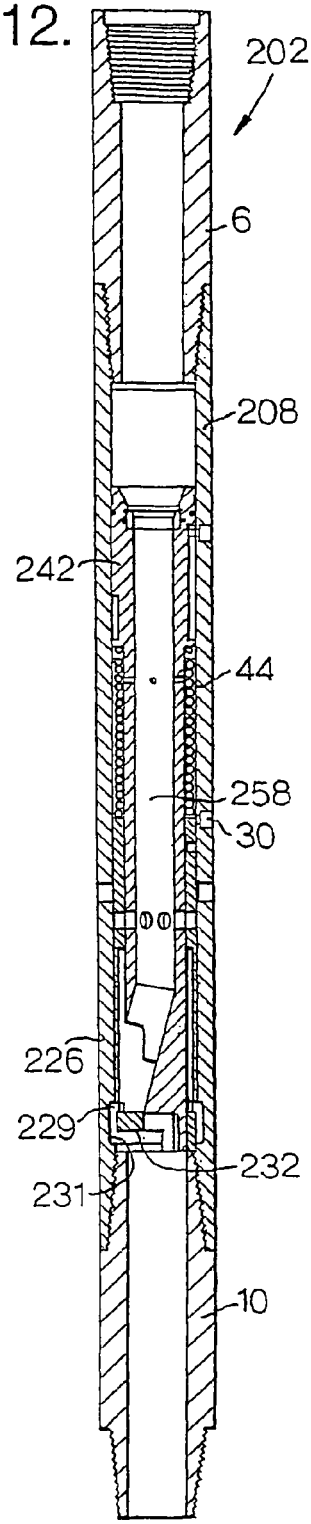

MULTI-CYCLE DOWNHOLE APPARATUS

BACKGROUND OF THE INVENTION

1. Field of the Invention

The present invention relates to downhole apparatus and particularly, but not exclusively, to multi-cycle circulating subs used during downhole drilling operations.

2. The Prior Art

It is often necessary in downhole drilling operations to bypass or partially bypass the flow of wellbore fluid down the drill string into the wellbore annulus. For example, this may be necessary where the desired fluid flow rate to drive a drilling tool is insufficient to carry all the drilled material up the annulus to the surface. In these circumstances, a circulating sub may be used to allow the flow rate required to remove the drilled material to be pumped into the annulus whilst maintaining the lower flow rate required at the drilling tool.

It is known to provide a circulating sub with an axially movable piston for opening and closing vent apertures. The vent apertures are provided in a body of the sub and allow wellbore fluid pumped downhole through a central bore of the sub to pass into the surrounding wellbore annulus. Opening and closing of the vent apertures by means of the piston is controlled by a pin and groove arrangement. The pin is located in one of the piston and body and is received within the groove provided in the other of the piston and body. The profile of the groove is such that axial movement of the piston results in rotation of the piston within the body. Furthermore, the extent of axial piston movement is limited by the groove profile. Thus, the piston may be moved axially downhole by means of a predetermined fluid flow rate and returned uphole by means of a biasing spring so as to cycle the piston into a position wherein the control groove permits subsequent movement of the piston from a vent aperture closed position to a vent aperture open position.

A problem associated with the aforementioned prior art means for controlling the piston is that there can be a tendency for the control pin to become damaged within the control groove as a result of axial and rotational forces acting on the piston. These forces can shear the control pin within the control groove.

In addressing this problem, our UK patent application number 0116472.2 provides apparatus comprising a piston slidably mounted in a body between positions in which at least one aperture in the body is opened and closed. Movement of the piston is controlled by one or more pins (secured to one of the body and a control member) and a control groove (formed in the other of the body and control member) in which a portion of the or each pin is received. An arrangement of elements respectively connected to the control member and body is such that, as the control member moves axially, lengths of said elements locate adjacent one another so as to provide resistance to relative rotation in at least one direction of the control member and body. The relative rotation is a rotation which presses the control member against the control groove. The elements are also arranged to limit axial movement of the control member. The apparatus thereby provides means by which the risk of damage to the control pin is reduced.

The present invention provides apparatus for selectively providing fluid communication between the interior of a downhole assembly and the exterior thereof said apparatus comprising: a body incorporating a wall provided with at least one aperture extending therethrough; a piston having a longitudinal bore extending therethrough and being slidably mounted in the body so as to be movable between a first position relative to the body preventing fluid communication between the bore of the piston and the exterior of the body via the or each aperture and a second position relative to the body permitting fluid communication between the bore of the piston and the exterior of the body via the or each aperture; and controlling means for controlling the movement of the piston between the first and second positions, the controlling means comprising: a control member slidable in the body and movable by fluid pressure in the body in a first axial direction relative to the body; a spring biasing the control member in an opposite axial direction of the body; a pin secured to one of the bodes and the control member; and a control groove in which a portion of the pin is received formed in the other of the body and the control member, the control groove being shaped to limit axial displacement of the control member generated by pressure variations in the body such that only after a predetermined number of movements of the control member to a first axial position is the control member able to move to a second axial position so as to displace the piston from one of the first and second piston positions to the other of the first and second piston positions; wherein the controlling means further comprises a first element connected to the control member so as to prevent relative rotation between the first element and the control member, and a second element connected to the body so as to prevent relative rotation between the second element and the body, wherein the arrangement of said element is such that, in the first axial position of the control member, the first and second elements normally abut one another so as to resist axial movement of the control member toward the second axial position, said elements locating offset relative to one another so as to allow movement of the control member to the second axial position only after a predetermined number of movements of the control member to the first axial position; and wherein the spring is located in a chamber defined between the control member and the body, and at least one vent opening is provided in the body for venting fluid located in the chamber to the exterior of the body. The arrangement of said elements may be such that, as the control member moves from said first axial position to said second axial position, increasing lengths of said elements locate adjacent one another so as to provide resistance to relative rotation, in at least one direction, of the control member and body, said relative rotation being relative rotation which presses the control pin against the control groove.

Thus, in apparatus according to the present invention, movement of the control member past the first axial position is normally prevented by an abutment of the first and second elements and, as a consequence, an undesirable application of axial pressure by the control groove on the control pin may be avoided. Also, as the control member moves from the first axial position to the second axial position and thereby displaces the piston into one of the first and second piston positions, elements connected to the control member and apparatus body locate adjacent one another so as to provide resistance to relative rotation of the control member and body. As a consequence, relative rotation which tends to press a control pin against the control groove can be resisted and damage to the control pin thereby avoided. The first and second elements may be arranged so as to allow relative rotation between the control member and body as may be permitted by the control groove profile. However, the elements do not allow rotation which will press the control pin and groove against each other to the extent that damage to the pin may occur. Furthermore, as the control member is moved from said first axial position to said second axial position, the elements locate adjacent one another to an increasing extent by virtue of said elements sliding over one another in a collapsing telescoping type of movement. Thus, as the control member moves towards the second axial position, the elements are better able to resist relative rotation due to the increasingly long lengths of element portions located adjacent one another. Also, since the spring chamber may be exposed to wellbore fluid pressure, a resultant fluid pressure may be applied to the control member which, in use, reduces the risk of an accidental cycling of the control pin within the control groove.

Ideally, at least one vent opening is provided in the control member for venting fluid located in the chamber to the exterior of the body. The or each vent opening in the control member or the body may also be occluded so as to prevent a passage of fluid therethrough. The or each occluded vent opening may be occluded with a removable plug. Thus, the spring chamber can be vented to the piston bore or wellbore annulus depending on which set of vent openings are occluded.

It is also desirable for the axial movement of the piston to be limited by one or more stop shoulders provided on the body. A first shoulder may limit axial movement of the piston in a first direction. A second shoulder may limit axial movement of the piston in a second direction opposite to said first direction. In this way, the application of axial thrust forces to the or each pin with the piston in the uppermost and lowermost positions may be avoided.

It is preferable for said first element to remain axially spaced from said second element until the control member is axially moved to the first axial position. The arrangement of the first and second elements may be such that said elements become offset to one another, so as to permit axial movement of said elements past one another, only after said predetermined number of movements of the control member to the first axial position. The said elements may be offset angularly. It is also preferable for the arrangement of the first and second elements to be such that, when said elements are offset so as to permit their axial movement past one another, the control pin is received in one of a plurality of portions of control groove allowing the control member to move to the second axial position. The arrangement of the first and second elements may also be such that, when said elements are offset so as to permit their axial movement past one another, the control pin is received in a portion of control groove allowing the control member either to displace the piston in said first axial direction from the first piston position to the second piston position and then to a third piston position preventing fluid communication between the bore of the piston and the exterior of the body via the or each aperture, or to displace the piston in said first axial direction from the second piston position to the first piston position and then to a third piston position permitting fluid communication between the bore of the piston and the exterior of the body via the or each aperture.

The control groove may comprise a plurality of said portions allowing displacement of the piston to said third piston position. Movement of the control member in said first axial direction past the second axial position may be prevented by means of an abutment of the second element with the control member or a component connected thereto. The second element may also be releasably connected to the body. The second element may be releasably connected to the body by means of a shear pin. When in the second piston position, the piston may be located so as to seal a fluid pathway through the apparatus and thereby, in use, direct fluid flowing into said apparatus through the or each aperture. Also, the or each aperture may be arranged so that wellbore fluid flowing in use through the or each aperture from the interior of the apparatus is directed in a direction having a component parallel to the longitudinal axis of the apparatus.

Embodiments of the present invention will now be described with reference to the accompanying drawing.

BRIEF DESCRIPTION OF THE DRAWINGS

FIG. 11 is a cross-sectional side view of the third tool of FIG. 9 arranged in an open configuration;

FIG. 11*a* is a cross-sectional view taken along line 11-11 of FIG. 11;

FIG. 12 is a cross-sectional side view of the third tool of FIG. 9 arranged in an emergency closed configuration;

DETAILED DESCRIPTION OF THE PREFERRED EMBODIMENTS

Figure 1:
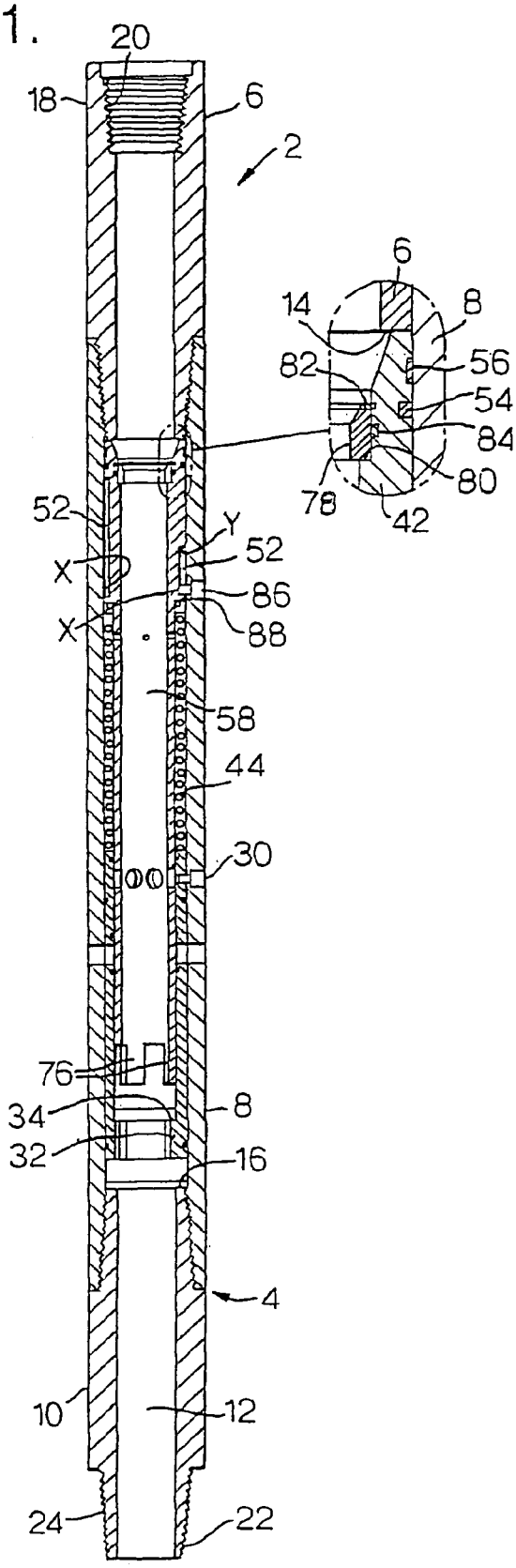
FIG. 1 is a cross-sectional side view of a first tool described in UK patent application number 0116472.2 arranged in a first closed configuration.

The first tool shown in FIGS. 1 to 4 of the accompanying drawings is a multi-cycle circulating sub 2 defined by a plurality of internal parts mounted within a substantially cylindrical body 4. The body 4 is defined by three cylindrical members 6, 8, 10 threadedly connected to one another so as to define an elongate bore 12. The first body member 6 is threadedly connected to an uphole end of the second body member 8 so as to provide a downwardly facing internal shoulder 14. The third body member 10 is threadedly connected to a downhole end of the second body member 8 so as to define an upwardly facing shoulder 16. An upper end 18 of the first body member 6 is provided with an internal screw thread 20 whilst a lower end 22 of the third body member 10 is provided with an external screw thread 24 so as to facilitate attachment of the circulating sub 2 to adjacent components of a downhole string.

In addition to the cylindrical body members 6, 8, 10 as described above, the body 4 may be considered to also incorporate a cylindrical sleeve 26 located in the elongate bore 12 between the downwardly and upwardly facing shoulders 14, 16. The sleeve 26 has an external diameter substantially equal to the internal diameter of the second body member 8. The external surface of the sleeve 26 is provided with two O-ring seals 28 for preventing axial fluid flow between said external surface and the internal surface of the second body member 8. The arrangement of the sleeve 26 within the second body member 8 is such that the sleeve 26 may slide axially within the bore 12. However, as will be explained hereinafter, such axial movement of the sleeve 26 occurs only during emergency conditions. During normal use of the circulating sub 2, the cylindrical sleeve 26 is selectively retained in a predetermined axial position relative to the second body member 8 by means of a shear pin 30. One or more shear pins may be provided.

At the downhole end of the sleeve 26, three elements 32 integral with the sleeve 26 extend inwardly from the interior surface of the sleeve 26 (see FIG. 3*a*) so as to provide three upwardly facing sleeve shoulders 34. The elements 32 extend only a short distance into the bore 12 so as to maintain a circular fluid path 38 therepast. As will be understood from the following discussion, the number of elements 32 may be varied so as to alter the number of cycles required to translate the circulating sub between open and closed configurations. The elements 32 are equi-spaced about the longitudinal axis of the circulating sub 2 and define slots 36 therebetween extending in a longitudinal direction. The three elements 32 are identical to one another and, accordingly, the slots 36 are identical to one another and equi-spaced about the longitudinal axis of the circulating sub 2.

The body 4 is provided with six apertures 40 extending radially through the wall thereof so as to allow fluid communication between the bore 12 and the exterior of the circulating sub. The apertures 40 lie in a single plane orientated perpendicularly to the longitudinal axis of the body 4. More specifically, the apertures 40 are provided in the second body member 8 and sleeve 26. The O-ring seals 28 are located uphole and downhole of the apertures 40 so as to prevent an ingress into the bore 12 of wellbore fluid located in the apertures 40.

The body 4 houses a plurality of internal parts including a piston 42 and a helical compression spring 44 as principal components. The piston 42 has a generally cylindrical shape with the upper part 46 thereof having a greater outer diameter than the lower part 48. The difference in diameter between the upper and lower parts 46, 48 of the piston 42 provides a piston shoulder 50 (see FIG. 2 in particular). The external surface of the upper part 46 is circumscribed by a control groove 52 having the unwrapped profile shown in FIG. 1*a*. The control groove 52 is provided in a direction having a first component parallel to the apparatus axis so as to allow axial movement of the piston 42, and a second component extending circumferentially so as to allow rotation of the piston 42. The control groove 52 is thereby formed to produce rotary indexing of the piston 42 as the piston 42 moves axially.

An O-ring seal 54 and wear ring 56 are provided on the external surface of the piston 42 above the groove 52. The piston 42 is also provided with a bore 58 having a sufficiently large diameter to allow the passage of wireline or coil tubing tools. It will be understood from FIGS. 1 to 4 that the external diameter of the piston upper part 46 is substantially equal to the internal diameter of the second body member 8, that the external diameter of the piston lower part 48 is substantially equal to the internal diameter of the sleeve 26, and that the diameter of the piston bore 58 is substantially equal to the diameter of the circular fluid path 38 past the three sleeve elements 32. The dimensions of the piston 42 relative to the body 4 are such as to allow ready axial movement of the piston 42 within the body 4.

The piston 42 is located in the bore 12 of the second body member 8 with the piston shoulder 50 positioned uphole of a spring shoulder 60 defined by the uphole end of the sleeve 26. The compression spring 44 extends between the spring shoulder 60 and the piston shoulder 50 so as to bias the piston 42 in an uphole axial direction towards the first body member 6. A bearing 62 is located between the spring 44 and the piston shoulder 50 so as to allow the piston 42 to rotate relative to the spring 44 more readily. Uphole displacement of the piston 42 is limited by the downwardly facing shoulder 14. The body 4 and the piston 42 thereby form a piston spring chamber 64 which is sealed by means of the piston O-ring seal 54 or glyd ring and a further O-ring seal 66 or glyd ring mounted in the inner surface of an uphole portion of the sleeve 26. The further seal 66 may be provided on the piston 42. The axial movement of the piston 42 within the bore 12 is assisted by the provision of vent holes 68 which, when in use, vent the piston spring chamber 64 to the piston bore 58. Four vent holes 68 are provided. The diameter of each vent hole 68 determines the degree of damping provided to the piston 42. Increasing the diameter of a vent hole 68 decreases the damping. The rate of piston movement may be thereby controlled and axial drilling vibration and shock inputs counteracted.

Figure 2:
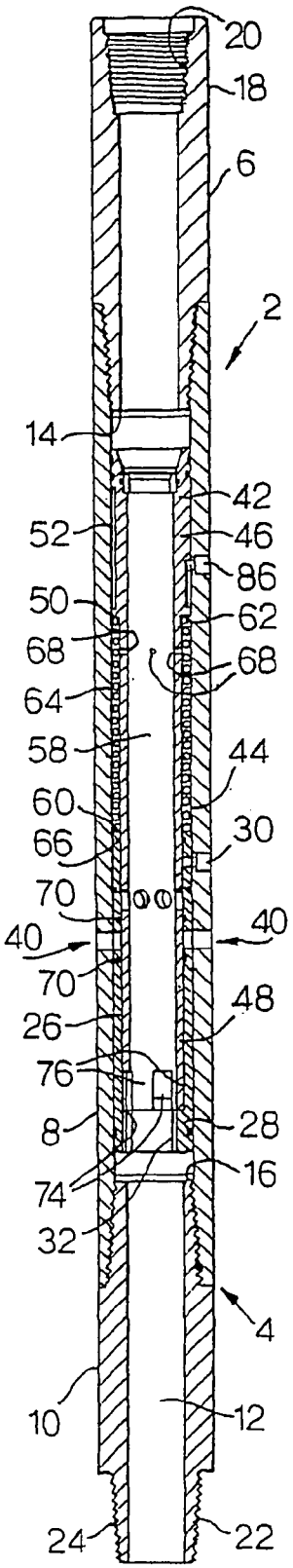
FIG. 2 is a cross-sectional side view of the first tool of FIG. 1 arranged in a second closed configuration with downhole movement of a sleeve restricted by the control groove and pin.
Figure 3:
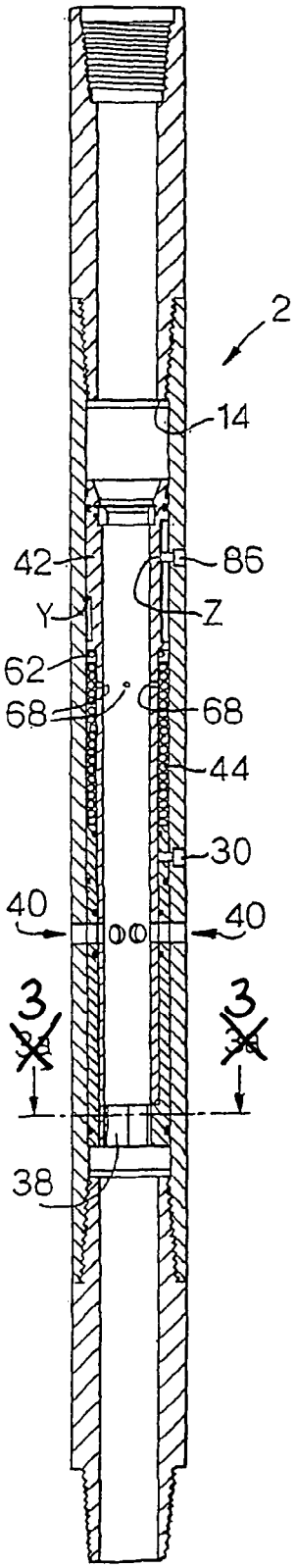
FIG. 3 is a cross-sectional side view of the first tool of FIG. 1 arranged in an open configuration.

As shown in FIG. 1, the length of the piston 42 is slightly less than the distance between the downwardly facing shoulder 14 and the three upwardly facing sleeve shoulders 34. Nevertheless, the piston 42 has sufficient length to extend downwardly past the apertures 40 of the body 4 when located in abutment with the downwardly facing shoulder 14. Two O-ring seals 70 or glyd rings located uphole and downhole of the body apertures 40 in the inner surface of the sleeve 26 prevent undesirable ingress of fluid in said apertures 40 into the circulating sub 2 between the sleeve 26 and piston 42 (i.e. prevents fluid leakage past the piston in the closed position). Nevertheless, the piston 42 is provided with six flow ports 72 which may be aligned with the apertures 40 through axial displacement of the piston 42 so as to permit a flow of wellbore fluid between the annulus and the interior of the circulating sub 2. More specifically, the flow ports 72 i.e. in a single plane orientated perpendicularly to the longitudinal axis of the piston 42. The flow ports 72 extend radially through the walls of the piston 42 and are of a similar diameter to the apertures 40. The arrangement of the flow ports 72 relative to the apertures 40 is such that, when the piston 42 is located in a closed position as shown in FIGS. 1 and 2, the flow ports 72 locate uphole of the apertures 40 and neighbouring seals 70 so as to isolate the bore 12 from the annulus, whereas when the piston 42 is located in an open position as shown in FIG. 3, the flow ports 72 alien with the apertures 40 and thereby provide a fluid pathway between the annulus and the bore 12.

The downhole end of the piston 42 is provided with three axially extending slots 74 (only two of which are visible in the accompanying drawings). The piston slots 72 extend through the full thickness of the piston wall and effectively provide three elements 76 downwardly projecting from the downhole end of the piston 42. The three piston elements 76 are equi-spaced about the longitudinal axis of the circulating sub 2 and have a length and circumferential width substantially identical to that of the sleeve slots 36. The relative sizes of the sleeve slots 36 and piston elements 76 are such that the piston elements 76 may align with and slide axially into the sleeve slots 36. Clearly, the circumferential width of the sleeve elements 32 relative to the piston slot 74 are also such that, when aligned, the piston slots 74 may slide axially over the sleeve elements 32. As with the piston elements 76 and sleeve slots 36, the circumferential widths of the piston slots 74 and sleeve elements 32 are substantially equal. The purpose of this equality of circumferential widths is to ensure that, when the elements 32, 76 are respectively engaged with the slots 34, 36, the relative rotation possible between the piston 42 and 44 is minimal. As will be understood from the following discussion, the purpose of the element/slot engagement is more specifically to prevent rotation of the piston 42 relative to the body 4 in one particular direction during movement of the piston 42 towards the open position shown in FIG. 3. Thus, an attempt by the piston 42 to rotate relative to the body 4 whilst the elements 32, 76 and slots 36, 74 are engaged will result in abutment of each sleeve element 32 with an adjacent piston element 76 at longitudinally extending edges thereof. Thus, in order to minimise possible relative rotation between the piston 42 and body 4, it is important for the aforementioned abutting edges to be in abutment with one another or at least very close to one another as the piston 42 begins movement towards the open position. The relative angular positions of the remaining longitudinally extending edges of the sleeve and piston elements 32, 76 which do not tend to abut one another in use (due to the direction of relative piston/body rotation) are not critical. To this extent, equality of the element and slot circumferential width is not essential to the operation of the circulating sub 2.

As most clearly shown in the expanded view of FIG. 1, a removable annular nozzle 78 is mounted in the piston bore 58 at an uphole end of the piston 42. The nozzle 78 is secured against an upwardly facing shoulder 80 defined in the piston bore 58 with an annular retaining ring 82. The retaining ring 82 is itself located in an annular groove provided in the piston bore 58. Fluid flow between the nozzle 78 and piston 42 is prevented by means of an O-ring seal 84. The purpose of the nozzle 78 is to provide a pressure drop in fluid flow passing through the piston bore 58. The nozzle 78 may be selected so as to provide a desired restriction in the piston bore 58 and thereby initiate downhole axial movement of the piston 42 within the body 4 at a given flow rate of fluid through the circulating sub 2.

A control pin 86 extends through the wall of the second body 8 so as to project into the bore 12 and locate in the control groove 52. The control pin 86 is secured in position by means of a retaining plug 88. One or more control pins may be provided. The shear pin 30 connecting the second body member 8 and sleeve member 26 also extends through an aperture through the wall of body member 8 and is retained in position by means of a retaining plug.

Figure 1A:
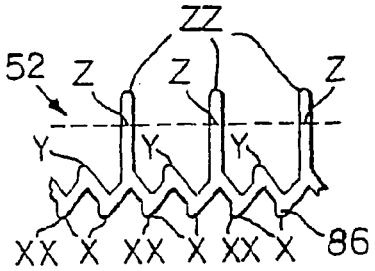
FIG. 1*a* is a plan view of the unwrapped profile of a control groove located relative to a control pin as shown in FIG. 1.

When in use, the multi-circulating sub 2 forms part of a downhole string through which well bore fluid may be pumped in order to operate equipment such as an anchor packer or a drilling tool, for example, a turbo drill or a positive displacement motor. FIGS. 1 and 1*a* show the circulating sub 2 arranged with the piston 42 located in an inactivated closed position. In this inactivated position, the piston 42 is located in abutment with the downwardly facing shoulder 14 of the second body member 8. The downhole end of the piston 42 (including the plurality of piston elements 32) is located uphole of the plurality of upwardly facing sleeve shoulders 34. Furthermore, the control pin 86 is located at one of six inactivated groove positions X within the control groove 52. The piston 42 will remain in the inactivated position until a predetermined flow of wellbore fluid through the circulating sub 2 is generated. As already indicated, the predetermined fluid flow may be adjusted by changing the dimensions of the nozzle 78. Once the predetermined fluid flow is generated or exceeded, the piston 42 will attempt to move to the activated open position shown in FIG. 3.

However, the axial movement of the piston 42 is controlled by the interaction of the control pin 86 and the control groove 52, and the piston 42 will be prevented from moving to the activated position unless the control pin 86 is located at one of three inactivated groove positions XX within the control groove 52 (see FIG. 1*a*) immediately before the predetermined flow rate is produced. If the control pin 86 is not located at one of said three inactivated groove positions A, then the axial movement of the piston 42 will result in the control pin 86 moving to one of three intermediate groove positions Y (see FIG. 1*a*). Although displaced axially, no part of the piston 42 has moved downwardly past the upwardly facing sleeve shoulders 34 when the control pin 86 is located at any one of the intermediate groove position Y see (FIG. 2). With the control pin 86 located in an intermediate groove position Y, the downhole ends of the piston elements 76 are abutting the sleeve shoulders 34. The relative angular position of the piston 42 and sleeve 26 is such that the piston and sleeve elements 76, 32 do not align with the sleeve and piston slots 36, 74. With the piston 42 located in either of the inactivated or intermediate positions shown in FIGS. 1 and 2 respectively, the flow ports 72 remain uphole of the body apertures 40 and sealed therefrom by means of the adjacent O-ring seal 70. Thus, a discharge of wellbore fluid from the sub 2 through the apertures 40 is prevented.

Figure 3A:
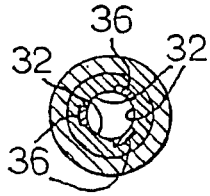
FIG. 3*a* is a cross-sectional view taken along line 3-3 of FIG. 3.

When the control pin 86 is located in one of the aforementioned three inactivated positions XX within the control groove 52 immediately before the predetermined flow rate is generated or exceeded, the profile of the control groove 52 allows the piston elements 76 to move rotationally into alignment with the sleeve slots 36 and to then allow the piston 42 to move axially downhole without further rotation (see FIGS. 3 and 3*a*). As the piston 42 moves downhole relative to the body 4, the control pin 86 moves within the control groove 52 from position XX to one of three activated groove positions Z (see FIG. 1*a*). With the control pin 86 located in one of the three activated groove positions Z, the flow ports 72 in the piston 42 align with the body apertures 40 so as to allow the discharge of wellbore fluid from the string into the surrounding wellbore annulus.

Also, with the circulating sub 2 arranged in the open configuration, the closed ends of the piston slots 74 abut the upwardly facing sleeve shoulders 34.

Movement of the piston 42 is assisted by the four vent holes 68 which allow fluid to flow between the piston spring chamber 64 and the piston bore 58 as the piston 42 moves axially and varies the volume of the spring chamber 64.

It will be understood that the piston and sleeve elements 76, 32 must be arranged so as to align with the sleeve and piston slots 36, 74 when the control pin 86 moves from the aforementioned inactivated positions XX to the activated groove positions Z. More importantly, the piston and sleeve elements 76, 32 should be arranged relative to one another so that should the piston 42 attempt to rotate (perhaps under the action of fluid imbalance in the piston bore) in opposition to the control groove and pin, adjacent piston and sleeve elements 76, 32 abut one another and prevent piston rotation. In this way, the application of undesirable forces on the control pin 86 is prevented. The risk of the control pin 86 becoming sheared and/or the piston 42 becoming jammed is thus reduced.

In order to move the control pin 86 from an intermediate groove position Y or activated groove position Z and move the piston 32 towards the inactivated position shown in FIG. 1, the rate of wellbore fluid flow through the circulating sub 2 is reduced below the predetermined rate so as to allow the compression spring 44 to relax and press the piston 42 into abutment with the first body member 6. Movement of the circulating sub 2 from an open configuration to a closed configuration may be thereby readily achieved. However, circumstances may arise where the piston 42 becomes jammed in a downhole position (perhaps due to debris) to the extent that the uphole biasing force of the compression spring 44 is insufficient to release the piston 42 even when the flow rate is reduced to zero. A situation may therefore arise where closing of the circulating sub 2 becomes problematic.

Figure 4:
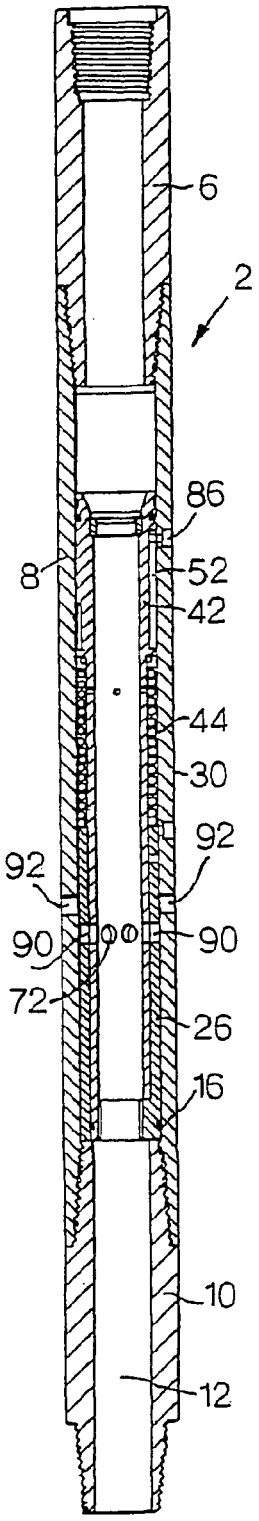
FIG. 4 is a cross-sectional side view of the first tool of FIG. 1 arranged in a third (emergency) closed configuration.
Figure 5:
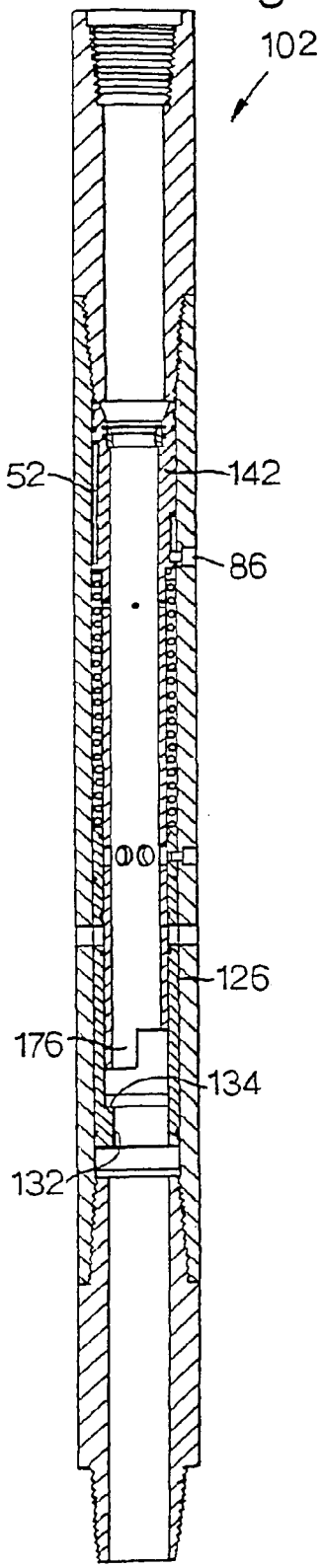
FIG. 5 is a cross-sectional side view of a second tool described in UK patent application number 0116472.2 arranged in a first closed configuration.
Figure 5A:
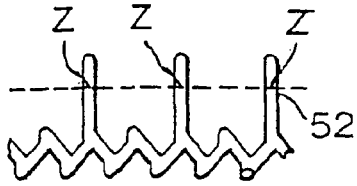
FIG. 5*a* is a plan views of the unwrapped profile of a control groove relative to a control pin as shown in FIG. 5.
Figure 6:
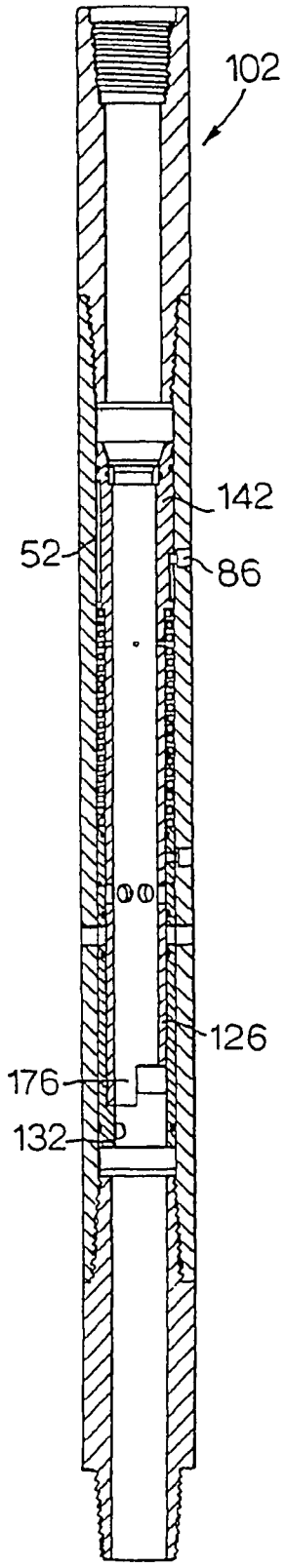
FIG. 6 is a cross-sectional side view of the second tool of FIG. 5 arranged in a second closed configuration with downhole movement of a sleeve restricted by the control groove and pin.

In the event that the circulating sub 2 becomes jammed in an open configuration, an attempt to move the circulating sub 2 to a closed configuration can be made by increasing the flow of fluid through the circulating sub 2 so as to shear the shear pin 30 and move the piston 42, together with the sleeve 26, downhole towards the third body member 10. It is envisaged that a greater resultant force on the piston 42 can be generated by a flow of fluid downhole through the borehole 12 than by the compression spring 44. Thus, it may well be possible to move a jammed piston 42 downhole by means of dynamic fluid pressure in circumstances where the compression spring 44 is unable to move the jammed piston 42 uphole. However, since downhole movement of the piston 42 is limited in the open configuration by means of the sleeve elements 32 (so as to ensure alignment of the body apertures 40 and the flow port 72), further downhole movement of the piston 42 must be accompanied by a downhole movement of the sleeve 26. The force applied by the fluid flow to the piston 42 must therefore be sufficient not only to release the piston 42, but also to shear the shear pin 30 and thereby allow movement of the sleeve 26. Once a sufficient force is generated to release the piston 42 and shear the shear pin 30, the piston 42 and sleeve 26 move downhole to an emergency closed position. The profile of the control groove 52 is such as to allow the further downhole movement of the piston 42. As shown in FIG. 4, the further downhole movement of the piston 42 is limited by abutment of the sleeve 26 with the upwardly facing shoulder 16 defined by the third body member 10. In the emergency closed configuration, the portions 90 of the body apertures 40 defined by the sleeve 26 remain aligned with the flow port 72 but locate downhole of the portions 22 of the body apertures 40 defined by the second body member 8. Also, in the emergency closed configuration, the control pin 86 locates in one of three extended groove positions ZZ.

Variations and modifications to the above described tool will be apparent to the reader skilled in the art. For example, the control groove 52 may have an alternative profile with a different number of inactivated, intermediate, activated and extended groove positions. The control groove 52 shown in FIG. 1*a* has a profile which causes the piston 42 to rotate through 120° when moving axially between successive intermediate or activated groove positions Y, Z. The profile may be altered so that the piston 42 rotates through a different angle when moving between these positions (consequential alternation to the arrangement of piston and sleeve elements 76, 32 may also be required as will be apparent to the skilled reader).

The circulating sub 2 shown in FIGS. 1 to 4 may be regarded as a two-cycle circulating sub in that two cycles of pressurising the sub in order to move the piston 42 axially downhole must be undertaken before the sub 2 will be translated from a closed configuration into an open configuration. The number of cycles is determined not only by the profile of the control groove 52, but also by the arrangement of the piston and sleeve element 76, 32. It will be understood that the number of cycles will be changed by altering the arrangement of the piston and sleeve elements 76, 32 without necessarily altering the profile of the control groove 52. This is because, although the activated groove positions Z of the control groove 52 may allow downhole movement of the piston 42 into an open position, piston movement to the open position will not be realised unless the piston and sleeve elements 76, 32 align with the sleeve and piston slots 36, 74. Thus, a six-cycle circulating sub 102 is shown in FIGS. 5 to 8 of the accompanying drawings, wherein the profile of the control groove is identical to that of the first tool. Indeed, the six-cycle circulating sub 102 differs from the two-cycle circulating sub 2 only in the arrangement of the piston and sleeve elements.

Figure 7:
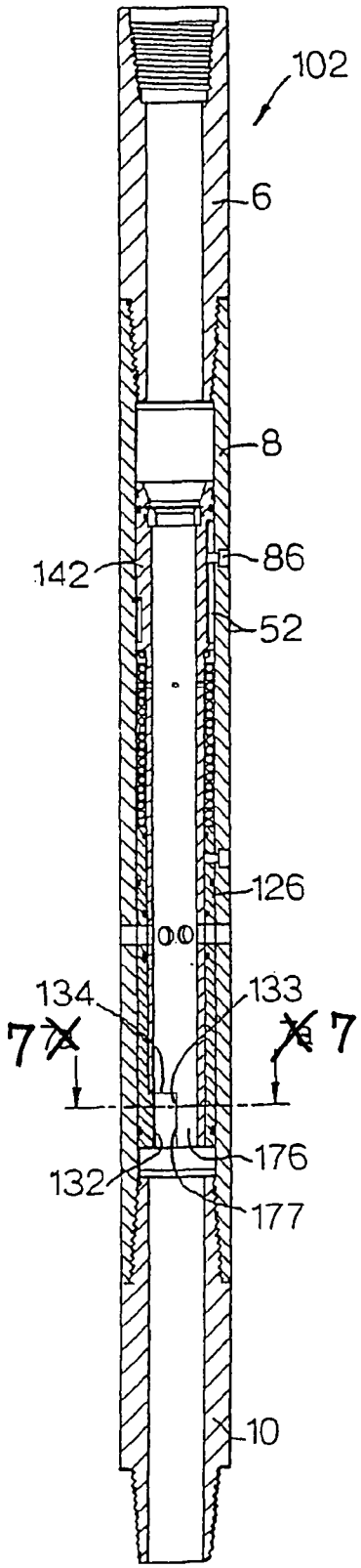
FIG. 7 is a cross-sectional side view of the second tool of FIG. 5 arranged in an open configuration.
Figure 7A:
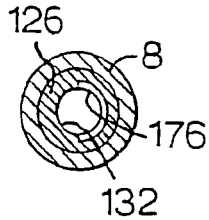
FIG. 7*a* is a cross-sectional view taken along line 7-7 of FIG. 7*a;*

As can be seen most clearly from FIG. 7*a*, the sleeve 126 and piston 142 of the second tool 102 each comprise merely a single element 132, 176 having a semicircular shape. The piston element 176 is arranged relative to the control groove 52 and the sleeve element 132 so that the control pin 86 is able to move to only one of the activated groove positions Z. Movement to the remaining two activated groove positions Z is prevented by abutment of the downhole end of the piston element 176 with the upwardly facing sleeve shoulder 134 defined by the sleeve element 132. However, when the sleeve and piston elements 134, 176 are positioned relative to one another so as to allow movement of the control pin to an activated groove position Z, abutment of the longitudinally extending edges 133, 177 of the sleeve elements 132 and piston elements 176 ensures rotation of the piston 142 relative to the second body member 8 in opposition to the control groove and pin is resisted. It will be understood therefore that the control groove 52 and sleeve/piston elements 132, 176 combine to provide a six-cycle indexing mechanism.

In order to provide improved versatility, the elements provided on the sleeve and piston may be respectively detachable from the sleeve and piston. This may be achieved by defining the elements on a cylindrical portion which is screw threadedly engageable with the lower part of the sleeve or piston. In this way, the cycle characteristics of a circulating sub may be rapidly and conveniently altered.

Figure 8:
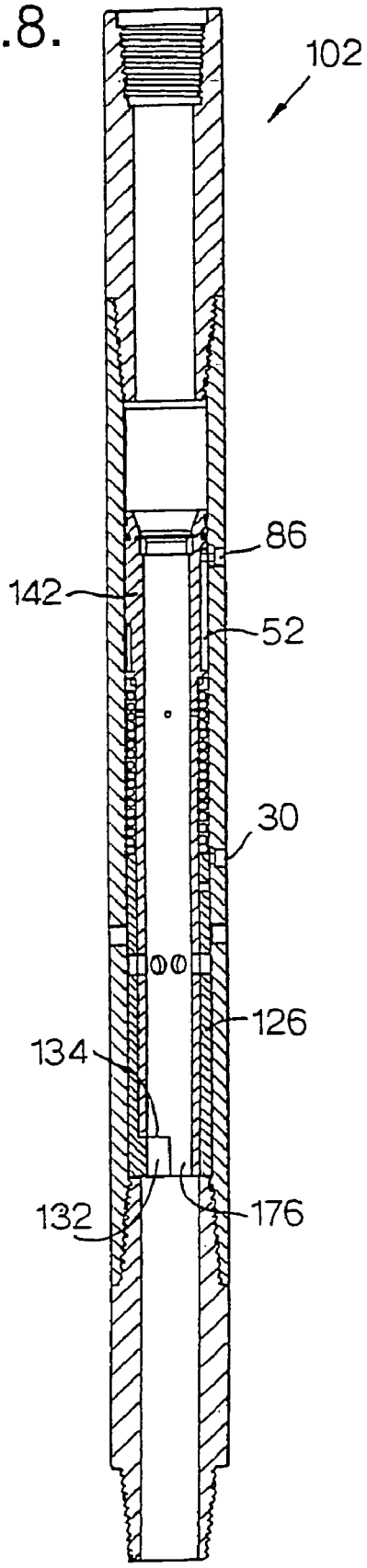
FIG. 8 is a cross-sectional side view of the second tool of FIG. 5 arranged in a third (emergency) closed configuration.

As shown in FIG. 8, the six-cycle circulating sub 102 may be moved to an emergency closed configuration (as with the first tool 2) by increasing the flow rate through the circulating sub 102 and shearing the shear pin 30.

Figure 9:
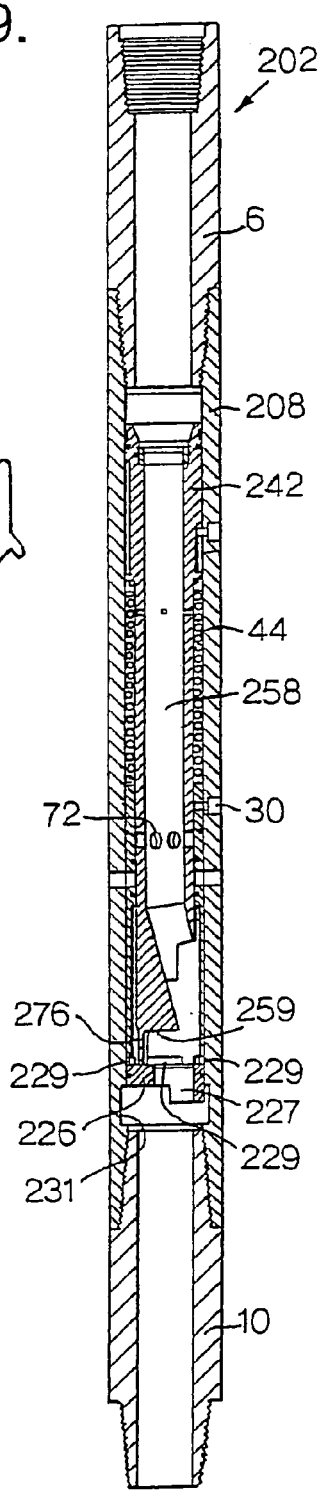
FIG. 9 is a cross-sectional side view of a third tool described in UK patent application number 0116472.2 arranged in a first closed configuration with downhole movement of a sleeve restricted by a control groove and pin.
Figure 9A:
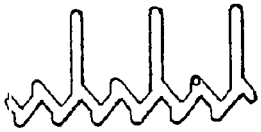
FIG. 9*a* is a plan view of the unwrapped profile of a control groove located relative to a control pin as shown in FIG. 9.
Figure 10:
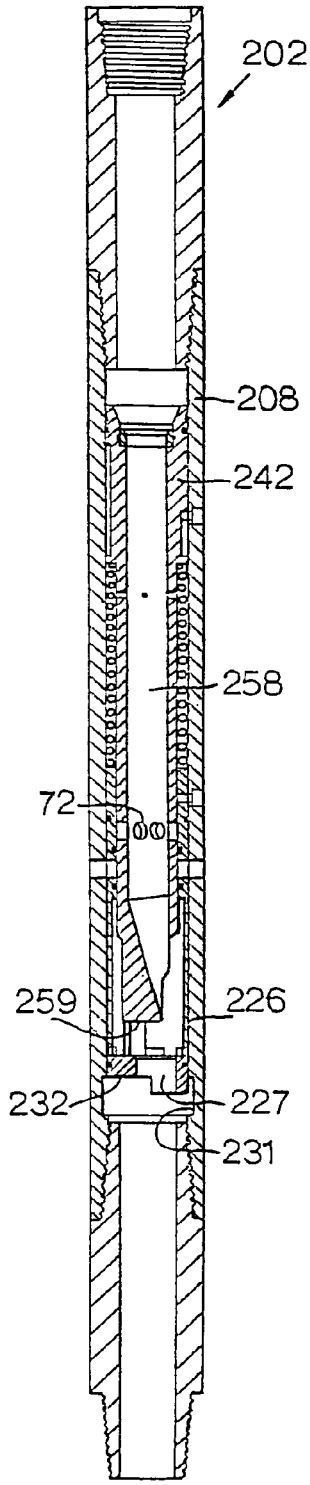
FIG. 10 is a cross-sectional side view of the third tool of FIG. 9 arranged in a second closed configuration with downhole movement of the sleeve restricted by the control groove and pin, and with the angular position of the sleeve differing to that shown in FIG. 9.
Figure 13:
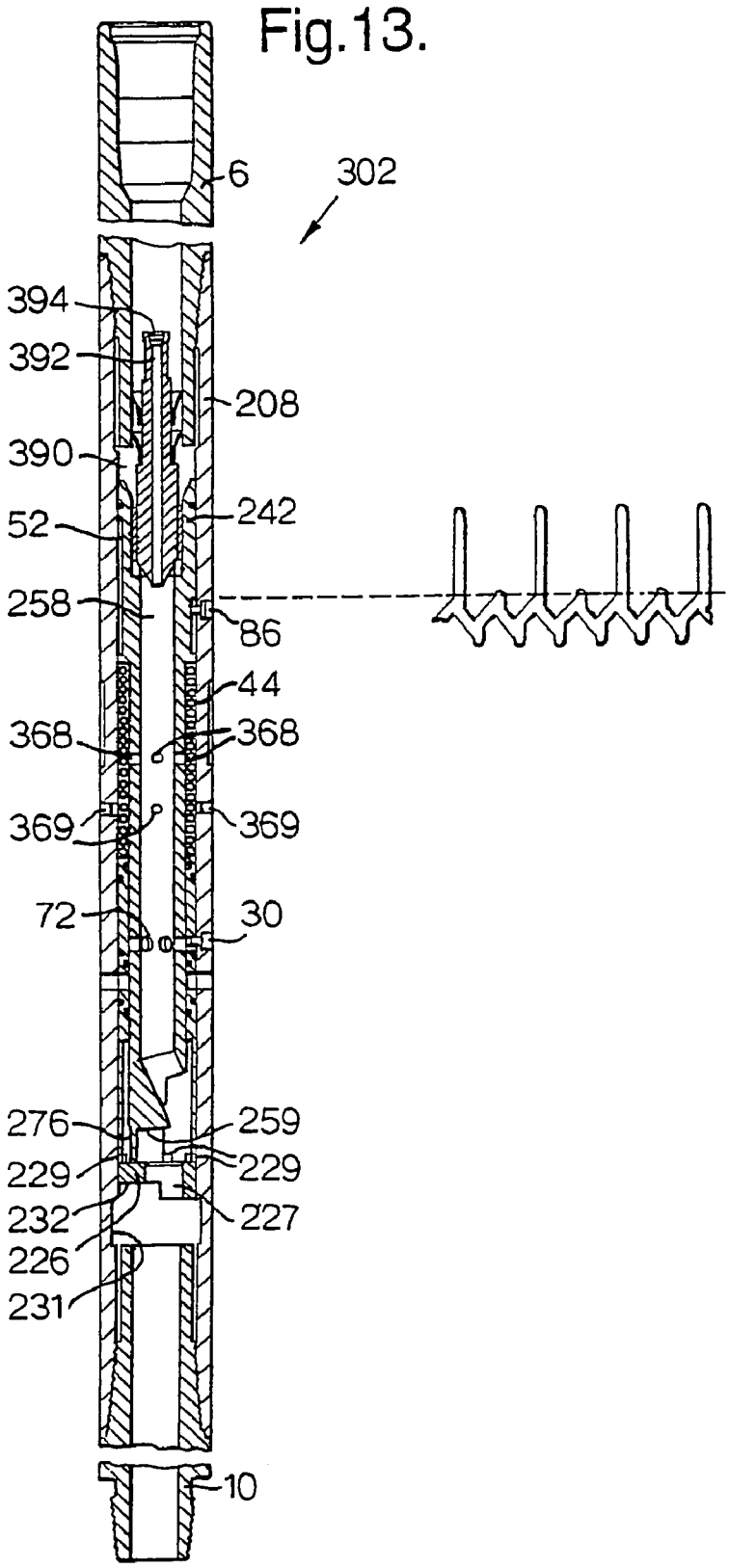
FIG. 13 is a cross-sectional side view of an embodiment of the present invention arranged in a first closed configuration with downhole movement of a sleeve restricted by a stop shoulder.

A third tool 202 is shown in FIGS. 9 to 12 of the accompanying drawings. The third tool 202 is a six-cycle circulating sub differing from the second tool 102 only in the arrangement of the downhole portions of the second body member 208, sleeve 226 and piston 242. The arrangement of these components is such that, when the piston is in a closed position as shown in FIGS. 9 and 10 (or an emergency closed position as shown in FIG. 12), wellbore fluid may flow through the interior of the circulating sub 202 as in the case of the first and second tools; however when the piston 242 is in an open position as shown in FIG. 11, the bore 12 through the circulating sub 202 is closed and all wellbore fluid flowing downhole through the circulating sub 202 is directed into the annulus by the body apertures 40.

More specifically, the downhole portions of the sleeve 226 and piston 242 are arranged with an asymmetric configuration. The piston 242 defines a piston bore 258 having an upper portion coaxially arranged with the longitudinal axis of the circulating sub 202 and a lower portion located downhole of the flow ports 72 which extends downhole at an angle relative to the longitudinal axis of the circulating sub 202. Accordingly, the downhole end of the piston bore 258 opens at a location offset from the longitudinal axis of the apparatus 202. This offset location provides a downhole facing piston shoulder 259 extending inwardly into the bore 12 of the circulating sub 202. A single piston element 276 extends downwardly from the shoulder 259. The downhole end of the sleeve 226 has a reduced diameter defining a restricted bore 227 within an axis offset relative to the longitudinal axis of the circulating sub 202. Uphole of the reduced diameter, the sleeve 226 is provided with four ports 229 which extend radially through the thickness of the sleeve 226.

When in the closed configuration as shown in FIGS. 9 and 10, wellbore fluid may flow through the circulating sub 202 via the piston bore 258, about the downwardly facing piston shoulder 259 and through the restricted sleeve bore 227. In FIG. 9, the circulating sub 202 is shown with the piston 242 displaced downhole against the bias of the compression spring 44 by means of an appropriate flow rate of well bore fluid. Displacement of the piston 242 into an open position is prevented by abutment of the piston element 276 against a single sleeve element 232 defining the restricted bore 227. The circulating sub 202 is shown in FIG. 10 cycled to a further closed configuration with the piston 242 having been rotated within the second body member 208. Again, movement of the piston 242 into the open position is prevented by abutment of the piston element 276 against the sleeve element 232. However, with the circulating sub 202 cycled to the configuration shown in FIGS. 11 and 11*a*, it will be seen that the piston 242 has rotated sufficiently for the piston element 276 to alien with the restricted bore 227 (acting as a sleeve slot) allowing the piston 242 to move further downhole relative to the sleeve 226. In so doing, the piston flow ports 72 align with the body apertures 40 (allowing flow to the annulus) and the downwardly facing piston shoulder 259 closes the restricted sleeve bore 227 (preventing fluid flow within the bore 12 downhole past the second body member 208). Fluid flow through the four ports 229 is not possible in the open and closed piston positions of FIGS. 9, 10, 11 and 11*a* due to the sealing of these ports by means of the second body member 208.

As described with relation to the first and second tools, the third tool 202 may be moved to an emergency closed position in the event that the piston 242 becomes jammed and the biasing force of the compression spring 44 is insufficient to return the piston 242 to its original uphole position in abutment with the first body member 6. Again, as described in relation to the first and second tools, the emergency closed configuration is achieved by increasing the flow of fluid through the bore 12. The flow rate is increased until the downhole force applied to the piston 242 is sufficient to release the piston 242 and shear the shear pin 30. The piston 242 and sleeve 226 are then moved downhole. Downhole movement of the piston 242 and sleeve 226 is limited by abutment of the sleeve 226 with the third body member 10. Although the restricted sleeve bore 227 remains sealed by the downwardly facing piston shoulder 259, flow through the bore 12 into the third body member 10 is permitted by means of the ports 229 provided in the sleeve 226. Flow through the ports 229 is possible with the sleeve 226 abutting the third body member 10 by virtue of a circumferential recess 231 provided in the interior surface of the second body member 208 at a downhole portion thereof. More specifically, the recess 231 is located uphole of the third body member 10 and downhole of the four ports 229 when the sleeve 226 is located in a non-emergency position (i.e. when retained by the shear pin 30 as shown in FIGS. 9 to 11*a*). The circumferential recess 231 has sufficient downhole length for wellbore fluid to flow through the sleeve ports 229, around and beneath the sleeve element 232, and into the third body member 10.

It will be understood that any of the above described tools may be moved to the emergency closed configuration by running means for closing the piston bore. For example, a ball or dart may be dropped or run on a wire line downhole through the apparatus so as to locate in the piston 42, 142, 242 and block the piston bore. The shear pin 30 will then shear and the apparatus will close. The ball or dart may then be recovered and circulation through the apparatus restored. Alternatively, a burst disc in the dart may be ruptured so as to allow circulation.

It has been found by the applicant that, although the tools described above in relation to FIGS. 1 to 12 have beneficial operating characteristics, the performance of the tools can nevertheless be improved with certain modifications. These modifications are described below in relation to first and second embodiments of the present invention shown in FIG. 1316 and FIG. 17 respectively of the accompanying drawings. The first embodiment is an improved six-cycle circulating sub 302. Apart from the modifications described below, the improved circulating sub 302 is identical to the third circulating sub 202 of FIGS. 9 to 12 and, accordingly, like reference numerals have been used to identify like components in the accompanying drawings.

A first modification comprised in the embodiment of FIGS. 13 to 16 is the provision of a second set of vent holes 369 to compliment the original set of vent holes 368 provided in the piston 242. The two sets of vent holes 368,369 provide for the venting of fluid from the piston spring chamber. Axial movement of the piston 242 is thereby assisted. However, whereas the original set of vent holes 368 are provided in the piston 242 for venting of fluid from the piston spring chamber into the piston bore 258, the second set of vent holes 369 are provided in the second body member 208 and thereby allow venting of fluid from the piston spring chamber to the exterior of the tool 302 (i.e. in use, to a wellbore annulus). Each set of vent holes 368, 369 comprises four holes (although, for either set, an alternative number of holes may be provided).

Figure 14:
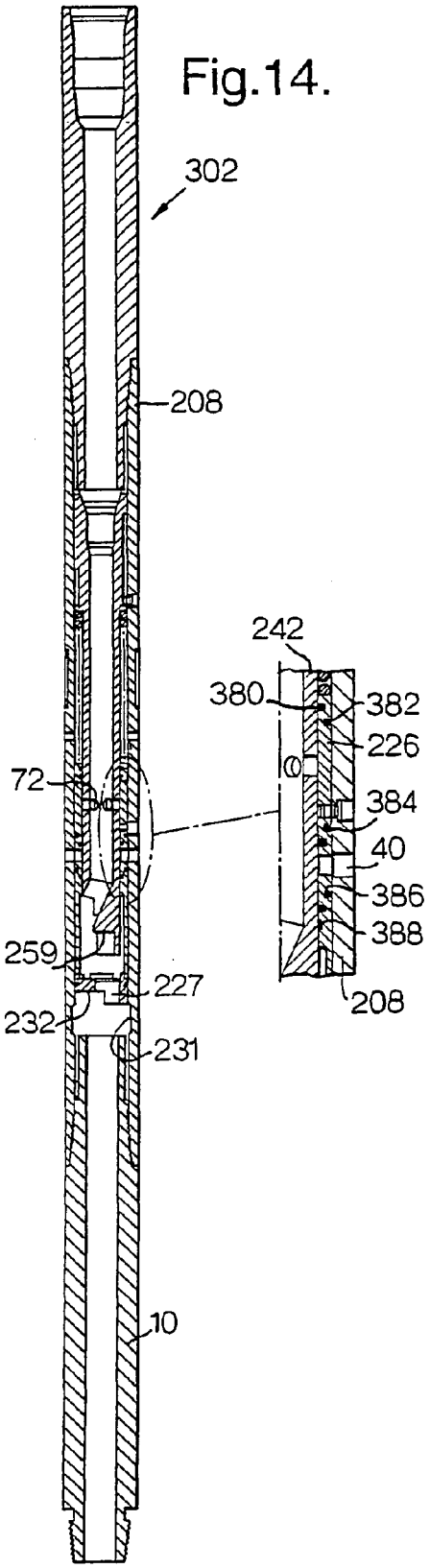
FIG. 14 is a cross-sectional side view of the embodiment shown in FIG. 13 arranged in a second closed configuration with downhole movement of the sleeve restricted by a stop shoulder, and with the angular and axial position of the sleeve differing to that shown in FIG. 13.
Figure 15:
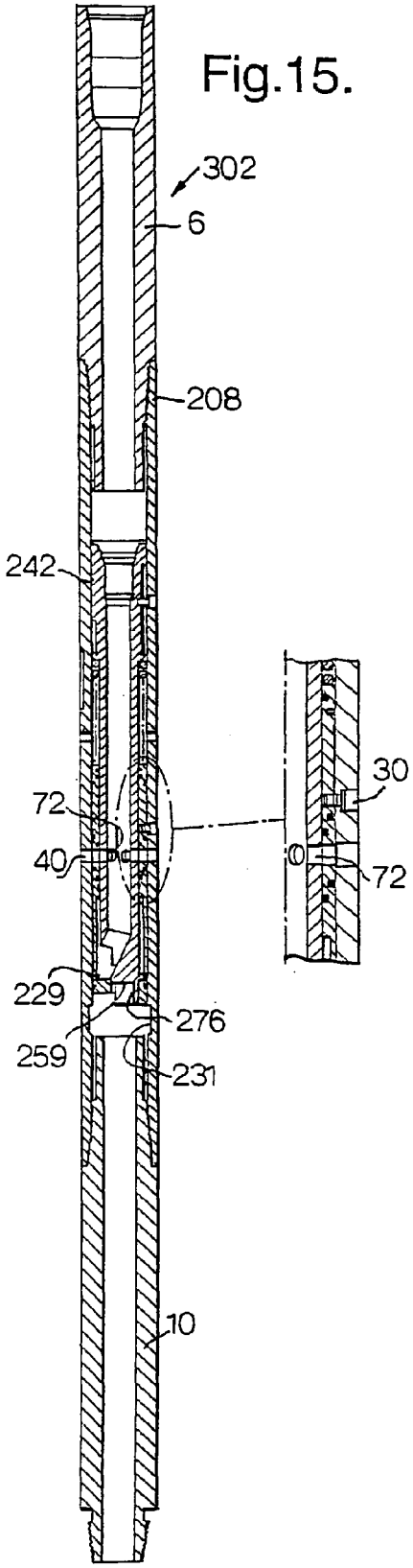
FIG. 15 is a cross-sectional side view of the embodiment of FIG. 13 arranged in an open configuration.
Figure 16:
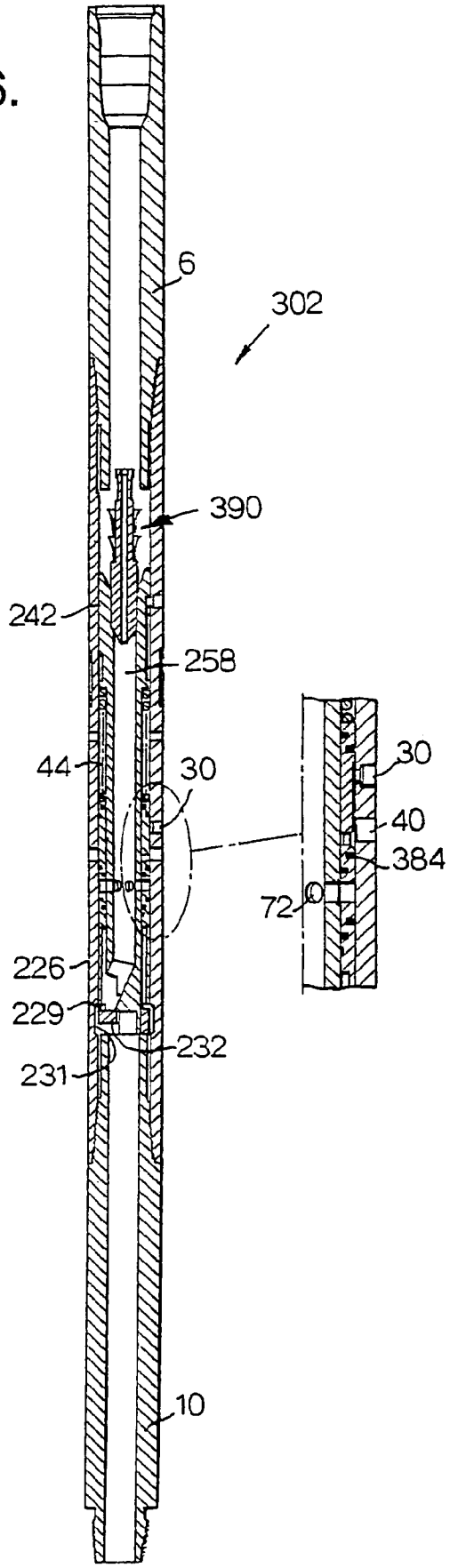
FIG. 16 is a cross-sectional side view of the embodiment of FIG. 13 arranged in an emergency closed configuration.

One of the two sets of vent holes 368,369 should be occluded depending on particular operational requirements. In the arrangement shown in FIGS. 13 to 16, each hole 369 of the second set of vent holes is occluded with a NPT plug. Venting is therefore achieved via the original set of vent holes 368. However, the original set of vent holes 368 may alternatively be occluded with NPT plugs with the second set of vent holes 369 being used to vent the piston spring chamber (as shown in FIGS. 14 to 16). With the second set of vent holes 369 open, the piston spring chamber becomes filled, in use, with wellbore fluid. The piston 242 is thereby exposed to wellbore fluid static pressure. This external fluid pressure will be less than the fluid pressure within the piston bore 258 when fluid is being pumped from the surface through the apparatus. With the annulus fluid pressure less than that in the piston bore 258, the resultant axial force will act in a downhole direction and have a greater magnitude than if the spring chamber was vented to the piston. This can have the benefit of reducing a tendency for the piston 242 to undesirably cycle due to vibration. In other words, the pressure differential across the length of the piston will hold the piston in a half-down position so the apparatus remains in a closed configuration whilst a drilling operation is completed.

When the improved sub 302 is arranged so that the spring chamber is vented to the wellbore annulus, the flow rate required to move the piston will be lower than when the spring chamber is vented to the piston bore 258. Also, when venting to the wellbore annulus, the improved sub 302 may be provided with a larger piston bore (or a piston nozzle having a larger bore). This can be advantageous since pressure losses across the sub 302 may be thereby reduced to allow increased pressure and greater system flow rates to be applied during drilling operations.

A high degree of axial vibration can occur when drilling hard rock formations and it is critical to drilling performance that the piston 242 is prevented from bouncing to such an extent that the body apertures 40 are opened. In venting the spring chamber to the annulus, the flow rate used during drilling will be considerably higher than the flow rate required to move the piston. In other words, during a drilling operation, the flow rate through the piston bore 258 will be sufficient to force the piston 242 downhole and retain the piston 242 in a closed position against uphole forces generated by axial vibration. In contrast, when the spring chamber is vented to the piston bore 258, the additional flow rate, used during drilling, over that used to move the piston 242, is reduced to an extent whereby there may be insufficient downhole force applied to the piston 242 to resist an uphole bouncing of the piston 242. Regardless of whether the spring chamber is vented to the annulus or the piston bore, an undesirable bouncing of the piston 242 can be limited by reducing the cross-sectional area of the flow passage from the spring chamber. In this way, the ease with which fluid may flow into the spring chamber so as to allow an uphole movement of the piston 242 is limited. Piston movement is thereby provided with a degree of dampening. The cross-sectional area of the vent passage may be reduced by occluding one or more vent holes with a plug or partially occluding one or more vent holes with a plug having one or more apertures provided therein.

With particular regard to the expanded partial views shown in FIGS. 14 to 16, it will be seen that the improved sub 302 comprises modifications to the arrangement of O-ring seals located between the second body member 208, the sleeve 226, and the piston 242. The improved sub 302 includes an additional O-ring seal 380 between the piston 242 and the sleeve 226, and a further additional O-ring seal 382 between the sleeve 226 and the second body member 208. The first additional O-ring seal 380 ensures that fluid within the piston bore 258 does not leak to the wellbore annulus via the flow ports 72 and second set of vent holes 369. The second additional O-ring seal 382 ensures that wellbore fluid cannot flow between the second body member 208 and the sleeve 226 via the body apertures 40. This is of particular importance when the second set of vent holes 369 are occluded so as to prevent ingress of wellbore fluid into the piston spring chamber. Without the second additional O-ring seals 382, wellbore fluid would flow into the piston spring chamber when the sub 302 is arranged in the emergency closed position.

A third additional O-ring seal 384 is provided between the sleeve 226 and the second body member 208 so that, when in the emergency closed position, wellbore fluid is prevented from accessing the flow ports 72 in the piston 242 via the body apertures 40. A fourth additional O-ring seal 386 is located between the sleeve 226 and the second body member 208 so as to assist in ensuring that fluid flows between the piston bore 258 and the wellbore annulus via the flow ports 72 and body apertures 40 without undesirable leakage between the sleeve 226 and the second body member 208. Also, a PTFE bearing support ring 388 is mounted on the sleeve 226 so as to assist in relative rotation between the sleeve 226 and the piston 242. A yet further modification is the provision of a location rim (i.e. an annular recess) on the uphole end of the sleeve 226 for receiving the downhole end of the spring. The spring location rim is not apparent in the enclosed drawings. It will be understood that any of the aforementioned O-ring seals may be replaced with or types of static seal.

Figure 17:
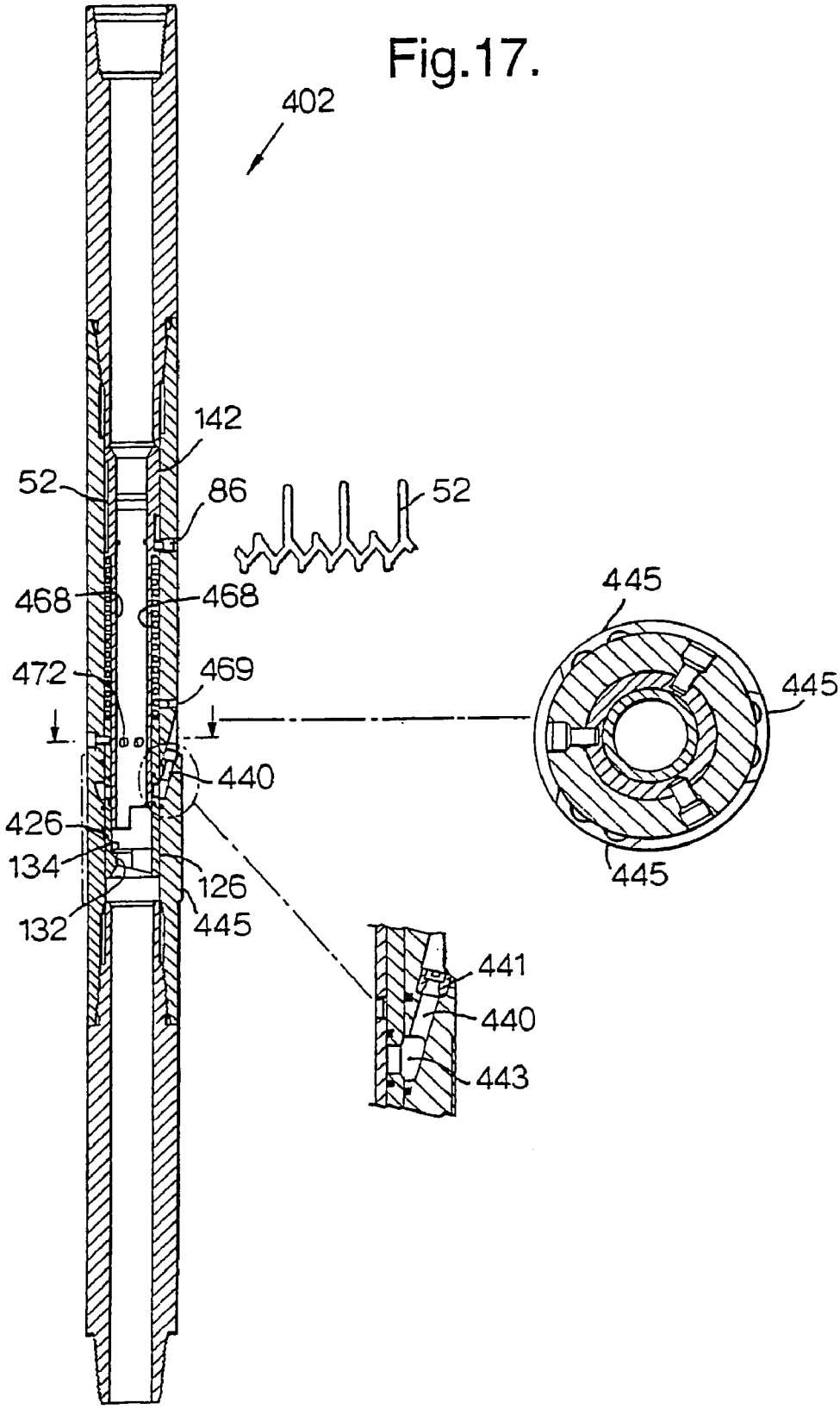
FIG. 17 is a cross-sectional side view of a second embodiment of the present invention arranged in a first closed configuration.

Although the improvements shown in FIGS. 13 to 16 have been described as modifications to the third tool shown in FIGS. 9 to 12, the described modifications may also be advantageously applied to the tools shown in FIGS. 1 to 8. Indeed, the second embodiment of the present invention shown in FIG. 17 is a modification of the tool shown in FIGS. 5 to 8 of the accompanying drawings. Apart from the modifications described below, the improved circulating sub 402 of FIG. 17 is substantially identical to the circulating sub 102 of FIGS. 5 to 8 and, accordingly, lice reference numerals have been used to identify like components in the accompanying drawings.

As with the first embodiment 302, the second embodiment 402 comprises two sets of vent holes 468,469 for venting the piston spring chamber. The set of vent holes 469 provided in the body comprises a single vent hole. Each hole of the second set of vent holes 468 is occluded with a NPT plug. Also, the body of the sub 402 is provided with a set of apertures 440 for allowing fluid communication between the bore of the sub and the exterior thereof. Each aperture 440 is provided as a fluid passageway arranged to direct fluid (flowing therethrough from the sub bore) in an uphole direction. To this end, each fluid passageway 440 has a longitudinal axis orientated at an acute angle to and in the same plane as the longitudinal axis of the sub 402. Each passageway 440 is also provided with a nozzle 441. The plurality of flow ports 472 provided in the piston 142 communicate with the single body aperture 440 by means of an annular fluid communication groove 443. The annular groove 443 is provided in the interior surface of the body. The uphole orientation of the body aperture 440 results in an uphole flow of annulus fluid being boosted by fluid exiting the body aperture 440 with an uphole flow component.

A further modification provided to the sub 402 is the provision of three sets of stabiliser blades 445 immediately downhole of the body aperture 440. Furthermore, the sleeve 426 may be provided in two components so as to ease manufacture. The two components of the sleeve 426 may be pinned or screw threadedly engaged with one another. The first embodiment shown in FIGS. 13 to 16 may also be provided with a multi-piece sleeve to assist with manufacture.

Furthermore, as already mentioned in relation to the tools of FIGS. 1 to 12, a dart may be run so as to block the piston bore and allow a sufficient build up of pressure to move a tool into the emergency closed configuration. The first embodiment of the present invention is shown in FIG. 16 located in the emergency closed configuration with a dart 390 blocking the piston bore 258. The dart 390 is shown in greater detail in FIG. 13 wherein it can be seen that the dart comprises a through bore 392 occluded at an uphole end thereof by a burst disc 394. The use of such a dart 390 allows fluid to be pumped through the sub 302 once the sub 302 has been moved to the emergency closed position. This is achieved by increasing the fluid pressure within the sub 302 so as to rupture the burst disc 394 and thereby allow access to the dart through bore 392. The pressure required to rupture the burst disc 394 will be greater than that required to shear the pin 30.

The present invention is not limited to the specific embodiments described above. Variations and modifications will be apparent to the reader skilled in the art.

The invention claimed is:

1. Apparatus for selectively providing fluid communication between the interior of a downhole assembly and the exterior thereof, said apparatus comprising: a body incorporating a wall provided with at least one aperture extending therethrough; a piston having a longitudinal bore extending therethrough and being slidably mounted in the body so as to be movable between a first position relative to the body preventing fluid communication between the bore of the piston and the exterior of the body via the or each aperture and a second position relative to the body permitting fluid communication between the bore of the piston and the exterior of the body via the or each aperture; and controlling means for controlling the movement of the piston between the first and second positions, the controlling means comprising: a control member slidable in the body and movable by fluid pressure in the body in a first axial direction relative to the body; a spring biasing the control member in an opposite axial direction of the body; a pin secured to one of the body and the control member; and a control groove in which a portion of the pin is received formed in the other of the body and the control member, the control groove being shaped to limit axial displacement of the control member generated by pressure variations in the body such that only after a predetermined number of movements of the control member to a first axial position is the control member able to move to a second axial position so as to displace the piston from one of the first and second piston positions to the other of the first and second piston positions; wherein the controlling means further comprises a first element connected to the control member so as to prevent relative rotation between the first element and the control member, and a second element connected to the body so as to prevent relative rotation between the second element and the body, wherein the arrangement of said elements is such that, in the first axial position of the control member, the first and second elements normally abut one another so as to resist axial movement of the control member toward the second axial position, said elements locating offset relative to one another so as to allow movement of the control member to the second axial position only after a predetermined number of movements of the control member to the first axial position; wherein the spring is located in a chamber defined between the control member and the body; and at least one vent opening is provided in the body for venting fluid located in the chamber to the exterior of the body, and wherein the arrangement of said elements is such that, as the control member moves from said first axial position to said second axial position, increasing lengths of said elements locate adjacent one another so as to prevent relative rotation, in at least one direction, of the control member and body, said relative rotation being relative rotation which presses the control pin against the control groove.

2. Apparatus as claimed in claim 1, wherein at least one vent opening is provided in the control member for venting fluid located in the chamber to the exterior of the body.

3. Apparatus as claimed in claim 2, wherein the or each vent opening in the control member is occluded so as to prevent a passage of fluid therethrough.

4. Apparatus as claimed in claim 1, wherein said first element remains axially spaced from said second element until the control member is axially moved to the first axial position.

5. Apparatus as claimed in claim 1, wherein the arrangement of the first and second elements is such that, when said elements are offset, the control pin is received in one of a plurality of portions of control groove allowing the control member to move to the second axial position.

6. Apparatus as claimed in claim 1, wherein the arrangement of the first and second elements is such that, when said elements are offset, the control pin is received in a portion of the control groove, allowing the control member either to displace the piston in said first axial direction from the first piston position to the second piston position and then to a third piston position preventing fluid communication between the bore of the piston and the exterior of the body via the or each aperture, or to displace the piston in said first axial direction from the second piston position to the first piston position and then to a third piston position permitting fluid communication between the bore of the piston and the exterior of the body via the or each aperture.

7. Apparatus as claimed in claim 6, wherein the control groove comprises a plurality of said portions allowing displacement of the piston to said third piston position.

8. Apparatus as claimed in claim 1, wherein movement of the control member in said first axial direction past the second axial position is prevented by means of an abutment of the second element with the control member or a component connected thereto.

9. Apparatus as claimed in claim 8, wherein the second element is releasably connected to the body.

10. Apparatus as claimed in claim 9, wherein the second element is releasably connected to the body by means of a shear pin.

11. Apparatus as claimed in claim 1, wherein, when in the second piston position, the piston is located so as to seal a fluid pathway through the apparatus and thereby, in use, direct fluid flowing into said apparatus through the or each aperture.

12. Apparatus as claimed in claim 1, wherein the or each aperture extending through the body wall is arranged so that wellbore fluid flowing in use through the or each aperture from the interior of the apparatus is directed in a direction having a component parallel to the longitudinal axis of the apparatus.

* * * * *